United States Patent [19]

Blaszkowski

[11] 4,177,965

[45] Dec. 11, 1979

[54] SOAP BAR AND HOLDER

[76] Inventor: Henry Blaszkowski, P.O. Box 114, Southfield, Mich. 48075

[21] Appl. No.: 914,859

[22] Filed: Jun. 12, 1978

Related U.S. Application Data

[63] Continuation of Ser. No. 718,183, Aug. 27, 1976, abandoned, which is a continuation-in-part of Ser. No. 585,706, Jun. 10, 1975, abandoned, which is a continuation-in-part of Ser. No. 392,817, Aug. 29, 1973, abandoned, which is a continuation-in-part of Ser. No. 274,641, Jul. 24, 1972, abandoned, which is a continuation-in-part of Ser. No. 93,000, Nov. 27, 1970, abandoned.

[51] Int. Cl.[2] ..... C11D 17/04

[52] U.S. Cl. ..... 248/359; 252/92

[58] Field of Search ..... 252/92, 90, 134, 174, 252/DIG. 16; D73/1 A; 248/309 R, 309 A, 359, 360

[56] References Cited

U.S. PATENT DOCUMENTS

| | | | |
|---|---|---|---|
| 624,809 | 5/1879 | Howe | 248/309 A |
| 2,920,417 | 1/1960 | Wertheimer | 252/92 |
| 2,988,841 | 6/1961 | Seufert et al. | 248/359 |
| 3,125,824 | 3/1964 | Staver | 248/359 |
| 3,315,933 | 4/1967 | Tatham | 248/359 X |

FOREIGN PATENT DOCUMENTS

| | | |
|---|---|---|
| 83416 | 3/1921 | Austria . |
| 12359 | of 1912 | United Kingdom . |

*Primary Examiner*—Harris A. Pitlick

*Attorney, Agent, or Firm*—Barnes, Kisselle, Raisch & Choate

[57] ABSTRACT

A soap bar and holder combination wherein the holder has a base, a shank and a head, the axis of which is perpendicular to the plane of the base, and the soap bar has an insert embedded therein formed with a cavity adapted to be telescoped over the head of the holder to removably support the soap bar on the holder. The diameters of the head and cavity are related so that the soap bar may be retained on the holder either loosely or firmly.

10 Claims, 4 Drawing Figures

SOAP BAR AND HOLDER

This application is a continuation of applicant's copending application Ser. No. 718,183, filed Aug. 27, 1976, now abandoned, which was a continuation-in-part of application Ser. No. 585,706, filed June 10, 1975 (now abandoned), which was a continuation-in-part of application Ser. No. 392,817, filed Aug. 29, 1973 (now abandoned), which was a continuation-in-part of application Ser. No. 274,641, filed July 24, 1972 (now abandoned), which was a continuation-in-part of application Ser. No. 93,000, filed Nov. 27, 1970 (now abandoned).

This invention relates to a soap bar and holder.

In my copending application Ser. No. 884,768, filed Mar. 9, 1978, there is disclosed a soap bar and holder designed such that the soap bar can be removed from the holder and used in the manner of a conventional soap bar or the soap bar may be retained on the holder, either firmly or loosely, and used when so retained by rubbing the hands or a washcloth over and around the soap bar. The soap bar and holder are also designed so that when the soap bar is retained on the holder it is generally parallel to the plane of the support surface to which the holder is affixed, regardless of whether such support surface is horizontal, vertical or inclined. The holder includes a suction cup base which enables the soap bar to be mounted on a horizontal surface of a washbowl, on the vertical side wall of a shower stall or bathtub, or on an inclined surface—such as within a washbowl. The holder and soap bar are also designed such that when the soap bar is retained on the holder it is spaced substantially from the base of the holder and the support surface. This not only enables one to rub his hands over substantially the entire surface of the soap bar, but also facilitates drying of the soap when not in use and cleaning of the support surface around the base of the holder without removing the soap bar from the holder.

The primary object of the present invention is to provide a soap bar and holder of the type described capable of being manufactured economically while still possessing the desirable basic functional and structural features of the soap bar and holder described as well as additional features.

More specifically, the present invention includes a soap bar having a plastic insert embedded therein. The insert reinforces the soap bar, is arranged so that it does not present an uncomfortable feeling to the user's hands or body when the soap bar diminishes in size through use, and can be formed inexpensively in molds of simple and economical design.

The present invention also includes a holder shaped so that it can be formed inexpensively from a plastic material in molds of economical design. The holder preferably has a base in the form of a suction cup which enables it to be removably, but securely, mounted at any desired location on a smooth surface which may be flat or even slightly concave or convex.

Furthermore, the soap bar and holder of this invention are designed such that the soap bar can be readily mounted on the holder without any conscious effort on the part of the user to orient the soap bar relative to the holder. This latter feature is achieved by disposing the head of the holder on an axis perpendicular to the suction cup base so that the user subconsciously realizes that the soap bar is properly oriented relative to the holder when the plane of the soap bar in the palm of the user's hand is generally parallel to the plane of the support surface on which the holder is mounted. In this connection the head of the holder is slightly smaller than the cavity in the insert which not only enables the soap bar to be loosely retained on the holder, but also enables the soap bar to be applied to and removed from the holder while slightly tilted with respect thereto.

Another feature of the invention resides in the construction of the soap bar and holder so that the soap bar can be either loosely retained on the holder without being accidentally dislodged therefrom or firmly and frictionally mounted on the holder.

Other features, objects and advantages of the present invention will become apparent from the following description and accompanying drawing, in which.

Figure 1:
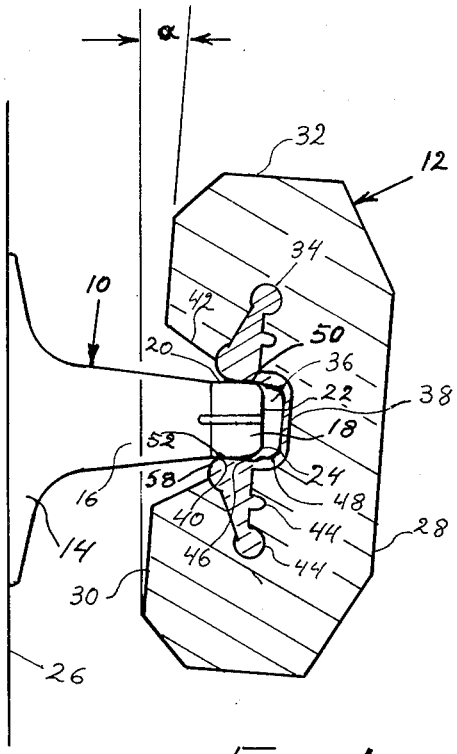
FIG. 1 is a view of a soap bar and holder of this invention showing the soap bar being mounted on or removed from the holder.

In the accompanying figures the holder is generally designated 10 and the soap bar is generally designated 12. Holder 10 includes a base 14 in the form of a suction cup, a shank 16 and a head 18. In the embodiment illustrated in FIGS. 1 and 2 head 18 is in the form of a circular cylindrical extension on shank 16 at the end thereof opposite base 14. The outer periphery of head 18 is defined by a cylindrical surface 20 of generally uniform diameter. The end face 22 of head 18 is connected to the cylindrical surface 20 by an annular curved surface 24. Preferably holder 10 is molded as one piece from a suitable plastic material (preferably resilient), such as rubber or the like. If desired, the suction cup 14 can be molded from rubber and the shank molded from a different material and affixed to the suction cup by any suitable means. In the drawing the holder is shown removably mounted on a vertically extending support surface 26 which may, for example, be the side wall of a shower stall or the vertical side wall of a bathtub or sink. As explained hereinafter, support surface 26 may also be a horizontal or an inclined surface.

Soap bar 12 is generally circular in shape as viewed in plan and has opposed faces 28,30 which are connected by an annular surface 32 around the periphery of the soap bar. The diameter of the soap bar is substantially larger than its thickness, that is, the distance between faces 28,30. For example, a typical soap bar according to the present invention would have a diameter of about three inches and a thickness of about one and one-half inches.

An insert 34 is embedded in the soap bar, preferably centrally between the faces 28,30 or closer to face 30 than face 28. Insert 34 is preferably in the form of a relatively thin circular disc having a central cavity 36 of circular cross section. The depth and the diameter of cavity 36 are relatively small in relation to the diameter of the insert. At one end cavity 36 is closed by an end wall 38. The other end of cavity 36 is open as at 40. The central portion of face 30 of the soap bar is in the form of an outwardly tapered socket 42 the inner end of which merges with insert 34 around a line spaced slightly radially outwardly from opening 40. Insert 34 is preferably molded from a somewhat rigid plastic material such as polyethylene so that it actually forms a relatively thin, but structurally strong, reinforcement located generally centrally within the soap bar. Insert 34 is fashioned with concentric annular ribs 44 on one or both sides thereof to insure a secure bonding of the insert with the soap bar at the interfaces thereof.

Location of the insert closer to face 30 than to face 28 is desirable when the soap bar will be used predominantly while on the holder since, when so used, face 28 will be worn down more rapidly than face 30. A relatively thin insert is desirable so that it will not interfere with the use of the soap bar until the bar is substantially completely consumed.

Figure 2:
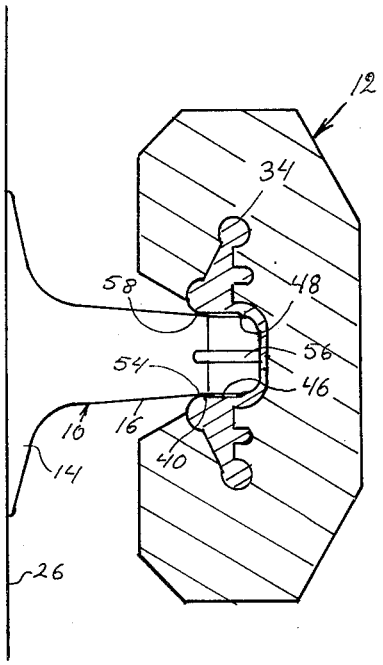
FIG. 2 shows the soap bar of FIG. 1 firmly retained on the holder.

In the arrangement illustrated in FIGS. 1 and 2 cavity 36 is defined by a circular cylindrical, axially outer portion 46 of uniform diameter and an inner cavity portion 48 of smaller diameter than cavity portion 46. The diameter of cavity portion 46 is slightly larger than the outer diameter of the cylindrical surface 20 of the head 18. A small clearance on the order of 0.005 to 0.010 inches enables the soap bar to be freely and readily telescoped over and removed from head 18 even though the soap bar is slightly inclined to support surface 26 as shown in FIG. 1. When the soap bar is placed loosely on the holder, the holder being affixed to a horizontal surface, it can be easily removed therefrom for use in the manner of a conventional soap bar or it may be used while so retained on the holder by simply rubbing the hands or a washcloth transversely over the generally flat top and peripheral surfaces of the soap bar. It is important to note, however, that the shank 16 of the holder is of such length that when the soap bar is retained on the holder loosely (FIG. 1) or firmly (FIG. 2), face 30 is spaced from the horizontal or vertical mounting surface 26 a distance amply sufficient (preferably at least three-quarters of an inch) to permit the user to encircle both faces 28,30 of the soap bar with his hands or a washcloth. It is also important to note that, even when the soap bar tilts or is cocked to the maximum allowable extent, the shank of the holder is out of contact with the surrounding outwardly flared portion 42 of the soap bar.

With the arrangement of this invention, if it is desired to retain the soap bar firmly on the holder, this can be accomplished by merely pushing the soap bar closer to the support surface 26 so that the free end of head 18 is seated in the smaller cavity portion 48 of the insert as shown in FIG. 2. In the arrangement illustrated cavity portion 48 has a diameter dimensioned so as to produce a close or an interference fit with the free end portion of head 18. Likewise, the portion 54 of shank 16 directly adjacent head 18 is dimensioned so that when the head 18 is fully seated in the smaller diameter cavity portion 48 of the holder it has an interference fit with the edge of opening 40. A difference in diameter of as little as 0.005 inches between opening 40 and portion 54 is sufficient to produce an interference fit. Thus, in the position illustrated in FIG. 2 the holder 10 is tightly embraced by the edge of opening 40 to firmly retain the soap bar on the holder. If the clearance between head 18 and cavity portion 46 is slight (0.005 to 0.010 inches), the provision of the smaller cavity portion may not be necessary. The interference fit between the edge of opening 40 and the bearing portion 54 on shank 16 may be all that is necessary to retain the soap bar firmly on the holder. It is apparent, of course, that in order to obtain such firm retention one or both of the mating parts must be relatively yieldable. At the same time it will be apparent that either head 18 or the cavity of the insert should be provided with one or more axially extending grooves or slots such as illustrated at 56 to prevent the entrapment of air or water between the head of the holder and the insert cavity. This prevents a pressure differential between the cavity and the surrounding atmosphere which would make it difficult to apply the soap to the holder or remove it from the holder.

It will be appreciated that holder 10 can be mounted on a vertical, a horizontal or an inclined support surface. In any event, the construction of the holder and the soap bar is such that the soap bar can be applied to the holder so as to be supported thereon without any conscious effort on the part of the user to align the axis of the insert cavity with the axis of the holder. This results from the fact that the axis of head 18 is perpendicular to the plane of support surface 26 and the annular curved surface 24 at the free end of the head cooperates with the curved surface 58 on the insert around opening 40 to form natural "lead-in" faces between the insert and the holder. Thus, the user unconsciously realizes that, if he positions the soap bar generally centrally over the holder and in a plane generally parallel to the plane of the support surface, movement of the soap bar toward the support surface will automatically interengage the insert with the holder. This is true even if the plane of the soap bar is inclined to a plane perpendicular to the axis of the holder at a slight angle as shown at a in FIG. 1. The relative dimensions of head 18 and cavity 36 should be such that angle a does not exceed 15° and is preferably about 5°. I have found that when the relative dimensions of the head 18 and cavity 36 are such that the maximum permissable tilt of the soap bar is not more than about 15°, the soap bar can be used while on the holder by rubbing one's hands transversely across face 28 and over the peripheral surface 32 without accidentally displacing the soap bar from the holder. If the holder is mounted on a horizontal surface, the soap bar will tilt as the hands are rubbed thereover such that the outer periphery of head 18 adjacent the free end thereof will bear against the cylindrical surface of cavity 36 at point 50 and on the opposite side thereof head 18 will bear against the cavity wall adjacent opening 40 at point 52. As long as bearing points 50,52 are located on generally cylindrical bearing surfaces, are spaced axially apart at least about one-third of the diameter of head 18, and prevent tilting of the soap bar not more than about 15°, the transverse force on the soap bar which results from rubbing one's hands across it will not have a tendency to cause the soap bar to ride up and over head 18 and off the holder, even though it is loosely supported thereon. On the other hand, if the spacing between bearing points 50,52 is at least one-third the diameter of the cavity and the maximum permissable tilting of the soap bar is on the order of 5° or less, then the soap bar will be supported in a stable position on the holder even when the holder is affixed to a vertical surface as shown in FIG. 1.

Figure 3:
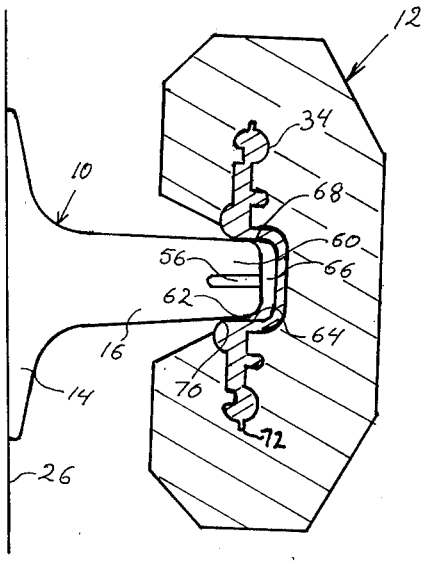
FIG. 3 is a view similar to FIG. 1 and showing another form of soap bar and holder.
Figure 4:
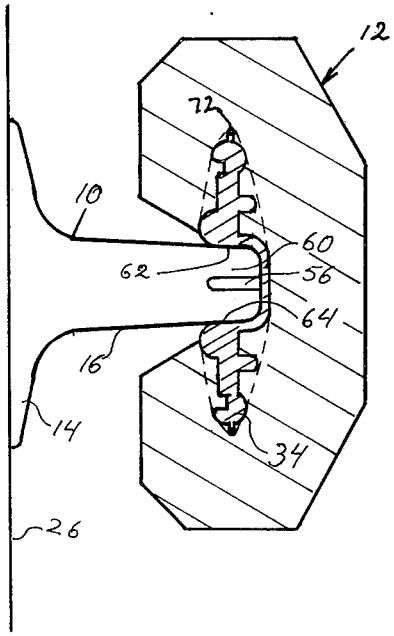
FIG. 4 shows the soap bar of FIG. 3 firmly retained on the holder.

The embodiment illustrated in FIGS. 3 and 4 differs slightly from that illustrated in FIGS. 1 and 2. In the arrangement illustrated in FIGS. 3 and 4 the head 60 of the holder 10 is formed with a very slight taper as illustrated at 62. This taper should not be so large as to cause the soap bar to slide off the end of the holder when the holder is mounted on a vertical support surface. The taper should provide a generally horizontal support surface for the soap bar when the holder is mounted on a vertical surface and should not exceed about 5°. The annular inner surface 64 of the cavity 66 of the insert is correspondingly tapered. However, the diameters of these surfaces are so related relative to the axial dimensions thereof such that when the soap bar is fully inserted over head 60 of the holder an interference fit between the head of the holder and the insert results. If desired the depth of cavity 66 can be dimensioned so that head 60 will not bottom against the end of the cavity if the soap bar is applied to the holder with only a slight force. In any event, when the soap bar is forced on the holder it is firmly retained thereon regardless of whether the holder is mounted on a vertical, horizontal or an inclined surface. If the insert is not forced over the head of the holder the soap bar will be loosely retained. However, the depth of cavity 66 is sufficient so that the soap bar may be loosely retained on the holder in the manner illustrated in FIG. 3 without being accidentally displaced from the holder, such as when it is inadvertently bumped. When the taper on the head of the holder is more than about 5° the soap bar will of its own accord tend to slide off the end of the holder when the latter is mounted on a vertical support surface. At the same time, if the axial spacing between the two bearing points 68,70 is equal to at least about one-third of the diameter of the head at the bearing point 70, the soap bar will be supported on the holder in a relatively stable position, provided that the respective diameters prevent the soap bar from tilting more than about 5° to the vertical. The slight taper referred to not only results in an interference fit with a slight application force, but also facilitates removal of the soap bar from the holder since the insert is completely loosened from the head of the holder after the soap bar is retracted only a very slight extent.

When the soap bars illustrated are removed from the holder and used in a conventional manner, the face 30 with the socket 42 will wear down at a faster rate than the face 28. On the other hand, when the soap is used predominantly while it is retained on the holder, the face 28 will wear down more rapidly than face 30. In any event, regardless of which side of the soap bar is consumed first, the insert is constructed so that it remains thoroughly bonded at its interface with the soap. As the soap bar diminishes in size the insert provides a reinforcement therein which reduces the likelihood of breakage and also tends to maintain the soap bar in a desirable shape until substantially all of the soap is consumed, except for a very small amount on the opposite faces of the insert between the outer peripheral edge thereof and the wall of the insert cavity on one side and the cavity opening on the other side. In the arrangement shown in FIGS. 3 and 4 a small radial flange 72 is incorporated on the insert around the extreme outer periphery thereof. Flange 72 prevents the peripheral edge of soap from breaking up and separating from the insert as the soap bar reduces in size through use. The soap bar can be considered substantially completely consumed when it wears down to the configuration illustrated by broken lines in FIG. 4. However, even when the soap bar wears down to this extent it can be rubbed between the hands or over the body without any uncomfortable sensation since there is an absence of surfaces on the insert protruding substantially beyond the adjacent soap surfaces. This is enhanced by the fact that in cross section the insert is widest at the central portion thereof and becomes thinner and tapers at the opposite faces thereof to a progressively smaller dimension in a direction radially outwardly by reason of the ribs 44 and the flange 72. In addition, the insert is preferably shaped so that its outer peripheral edge lies generally in the central plane of the insert. Thus, the shape of the insert not only reinforces the soap bar and prevents its separation from the soap, but also imparts an ideal configuration to the soap bar as it wears down to the shape designated by broken lines in FIG. 4.

It will be understood, of course, that the interference fit referred to previously is of significance for retaining the soap bar firmly on the holder. This is of particular importance when the holder is mounted on a vertical surface. However, the interference fit should not be so tight as to require an unduly large force to remove the soap bar from the holder. The interference fit should be such as to enable removal of the soap bar with just a slight pull. For example, a typical soap bar according to the present invention would have a diameter of about three inches, a thickness of about one and one-half inches, and would weigh about six ounces. With such a soap bar the degree of interference fit between the insert and the head of the holder should be such as to require a pull on the soap bar of not more than about eight or ten ounces to remove the soap bar from the holder. When the head of the holder is a roughened surface, as distinguished from a slippery smooth surface, a better gripping action is obtained and, at the same time, the need for a groove or slot such as shown at 56 may be avoided since the entrapment of air or water between the insert cavity and the head of the holder is less likely.

I claim:

1. In combination, a soap bar having a pair of opposed faces spaced apart a distance substantially less than the lateral extent of said faces, an insert formed of a water insoluable material embedded in said soap bar and firmly bonded thereto at the interfaces of the soap bar and the insert, said soap bar having a socket therein of generally circular cross section extending from said insert to one of said opposed faces, said insert having a lateral dimension greater than the diameter of the inner end of said socket and being oriented in the soap bar so that it is spaced inwardly from both of said opposed faces and so that its lateral dimension lies in a plane generally parallel to the lateral dimension of the soap bar, said insert having a cavity therein of circular cross section, the axis of which is perpendicular to the plane of the lateral dimension of the soap bar, said insert having an end wall at the axially inner end of the cavity and having a circular opening axially opposite said end wall which is concentric with the axis of the cavity, said opening providing a passageway between the inner end of the socket and the cavity, said opening being concentric with the axis of the socket and having a diameter smaller than the lateral dimension of the socket at the inner end thereof so that the line of junction between the inner end of the socket and the insert is spaced radially outwardly of said opening and radially inwardly of the periphery of the insert, the axial dimension of said insert between said line of junction and the interface between said end wall and the soap bar being less than the lateral dimension of the insert, and a holder for the soap bar having a base adapted to be affixed to a support surface and having a shank fixed to and extending from said base so that the shank extends generally perpendicular to the support surface on which the base is affixed, said shank having a head at the free end thereof, said head being sized for removable insertion into said cavity through said opening, said head having an axial dimension corresponding generally to the axial dimension of the cavity from said opening to said end wall, the axial dimension of the portion of the shank extending from said base to said head being substantially greater than said axial dimension of said head to provide ample clearance for enabling the user to wrap his fingers around the soap bar and rub them across said one face when said head is inserted into said cavity, the outer periphery of said head defining a generally cylindrical bearing surface concentric with the axis of said shank, said cavity defining a generally cylindrical bearing surface concentric with the axis of said opening and extending between said end wall and said opening, the diameters of said bearing surfaces being dimensionally related at axially spaced sections thereof so that, when the head is fully inserted into said cavity, the bearing surfaces interengage such that the soap bar is substantially incapable of being tilted relative to the shank of the holder and, when the head is less than fully inserted into said cavity, the soap bar is loosely and tiltably retained on the holder.

2. In combination, a soap bar having a pair of opposed faces spaced apart a distance substantially less than the lateral extent of said faces, an insert formed of a water insoluable material embedded in said soap bar and firmly bonded thereto at the interfaces of the soap bar and the insert, said soap bar having a socket therein of generally circular cross section extending from said insert to one of said opposed faces, said insert having a lateral dimension greater than the diameter of the inner end of said socket and being oriented in the soap bar so that it is spaced inwardly from said opposed faces and its lateral dimension lies in a plane generally parallel to the plane of the lateral dimension of the soap bar and generally perpendicular to the axis of said socket, said insert having a cavity therein of circular cross section, the axis of which is perpendicular to the plane of the lateral dimension of the soap bar, said cavity having an end wall at the axially inner end thereof and a circular opening at the axially outer end thereof concentric with the axis of the cavity and providing a passageway between the inner end of said socket and the cavity, said opening being concentric with said socket and being of smaller diameter than the inner end of the socket so that the line of junction between the inner end of the socket and the insert is defined by a circle concentric with and of larger diameter than said opening, the axial dimension of said soap bar between said line of junction and the interface between said end wall and soap bar being less than the lateral dimension of the insert, and a holder for said soap bar having a base adapted to be affixed to a support surface and having a shank fixed to and extending from said base so that said shank extends generally perpendicular to the support surface on which the base is affixed, said shank having a head at the free end thereof, said head having an outer, axially extending annular surface forming a generally cylindrical, axially extending bearing surface thereon concentric with and generally parallel to the axis of the shank, said cavity being defined by an annular surface forming an axially extending, generally cylindrical bearing surface axially adjacent to, concentric with and generally parallel to the axis of the opening in the insert, said bearing surface of the cavity terminating at its axially inner end in a plane disposed axially outwardly of said end wall and having a diameter at least equal to the diameter of said opening, the diameters of said opening and said bearing surface of the cavity being not more than about 0.010" larger than the diameter of the bearing surface on the head to enable the insert to be freely telescoped over said head but being sufficiently small to limit the extent to which the soap bar can be tilted to the plane of the support surface to an angle of not more than about 15° when said annular bearing surfaces are fully telescopically engaged such that the axially leading end portion of the bearing surface on the head engages the axially inner end of the bearing surface in the cavity, said socket being of sufficiently large diameter throughout its length to prevent contact of the soap bar with the shank of the holder when the soap bar is so inclined, said holder and insert having additional annular surfaces thereon which are adapted to interengage with an interference fit when the insert is telescoped further over said head to a position wherein the axially leading end portion of the bearing surface on the head is disposed axially inwardly beyond the axially inner end of said bearing surface of said cavity whereby the soap bar is adapted to be retained either loosely or firmly on the holder, the axial dimension of the portion of the shank extending from said base to said head being substantially greater than the axial dimension of said head to provide ample clearance for enabling the user to wrap his fingers around the soap bar and rub them across said one face when the soap bar is retained on the holder in said firm position.

3. The combination set forth in claim 2 wherein, when the soap bar is supported on said holder in said tilted position wherein said leading end portion of the bearing surface on the head end engages the axially inner end of the bearing surface of the cavity at one point, another portion of the bearing surface on the head adjacent said shank and at the diameterically opposite side of the head engages and bears against the edge of the opening at a point on the diametrically opposite side of the cavity and said points of bearing engagement are spaced apart axially at least about one-third of the diameter of the bearing surface of said cavity.

4. The combination set forth in claim 3 wherein the diameters of the opening and the bearing surface of the cavity are dimensioned relative to the diameter of the bearing surface on the head such that, when said bearing surfaces are in said fully telescopically engaged position said bearing points limit the maximum extent to which the soap bar can be tilted to the plane of the support surface on which the holder is mounted to an angle of not more than about 5°.

5. The combination set forth in claim 2 wherein the axially outermost portion of the bearing surface of the cavity is defined by the edge of said opening.

6. The combination set forth in claim 2 wherein the portion of said shank directly adjacent said head comprises one of said additional annular surfaces and is dimensioned to have an interference fit with said opening, said cavity having a depth sufficient to enable interengagement of said opening with said portion of said shank.

7. The combination set forth in claim 2 wherein said cavity has a second bearing surface at the inner end thereof having a diameter smaller than the first-mentioned bearing surface in the cavity and adapted to receive the free end portion of said head with a close fit, said additional annular surface on the holder comprising a second bearing surface on said shank adjacent said head which has an interference fit with said opening, at least one of said head and insert being sufficiently yieldable to permit said interference fit engagement whereby, when the soap bar is mounted on the holder in a position wherein the first-mentioned bearing surfaces on the head and cavity are in said fully telescopically engaged position, the free end portion of the head is spaced axially from said end wall of the cavity and the soap bar is retained loosely, but in a stable position, on said holder and, when the insert is telescoped further over said head to engage the edge of the opening with the second bearing surface of the shank and to telescope the free end of the head into the second bearing surface of the cavity, the soap bar is retained firmly on the holder.

8. The combination set forth in claim 7 wherein the diameter of the second bearing surface of said cavity is slightly smaller than the diameter of the free end portion of said head to produce an interference fit therewith.

9. The combination set forth in claim 2 wherein said insert is located in said soap bar generally centrally between said opposed faces, said socket flaring outwardly from adjacent the opening on said insert toward said one face to facilitate application of the soap bar to the holder and to prevent contact between the soap bar and the shank of the holder.

10. In combination, a soap bar having a pair of opposed faces spaced apart a distance substantially less than the lateral extent of said faces, an insert formed of a water insoluable material embedded in said soap bar and firmly bonded thereto at the interfaces of the soap bar and the insert, said soap bar having a socket therein of generally circular cross section extending from said insert to one of said opposed faces, said insert having a lateral dimension greater than the diameter of the inner end of said socket and being oriented in the soap bar so that it is spaced inwardly from said opposed faces and its lateral dimension lies in a plane generally parallel to the plane of the lateral dimension of the soap bar and generally perpendicular to the axis of said socket, said insert having a cavity therein of circular cross section, the axis of which is perpendicular to the plane of the lateral dimension of the soap bar, said insert having a circular opening therein concentric with the axis of the cavity and providing a passageway between the inner end of said socket and said cavity, said opening being concentric with the axis of said socket and being of smaller diameter than the inner end of the socket so that the line of junction between the inner end of said socket and the insert is defined by a circle concentric with and of larger diameter than said opening, said insert having an end wall at the axially inner end of said cavity, the axial dimension of said insert between said line of junction and the interface between said end wall and the soap bar being less than the lateral dimension of the insert, and a holder for said soap bar having a base adapted to be affixed to a support surface and having a shank fixed to and extending from said base so that said shank extends perpendicular to the support surface on which the base is affixed, said shank having a head at the free end thereof, said head and cavity each being defined by peripheral surfaces which form bearing surfaces thereon which are adapted to interengage when the insert is telescoped over said head, said bearing surfaces being correspondingly tapered and dimensioned such that the insert can be telescoped over said head to a predetermined extent to be loosely retained thereon or to a greater extent into tight fitting engagement with said head to frictionally retain the soap bar on the holder, the tapered surface of the cavity being concentric with the axis of the opening and the tapered surface of the head being concentric with the axis of said shank, said taper being not greater than 5° to the axis of the shank and opening.

* * * * *